US007518483B2

(12) United States Patent
Brede et al.

(10) Patent No.: US 7,518,483 B2
(45) Date of Patent: Apr. 14, 2009

(54) APPARATUS FOR THE CUTTING OF AN ELECTRICAL CONDUCTOR

(75) Inventors: Uwe Brede, Fuerth (DE); Uwe Albrecht, Nuremberg (DE)

(73) Assignee: Delphi Technologies, Inc., Troy, MI (US)

( * ) Notice: Subject to any disclaimer, the term of this patent is extended or adjusted under 35 U.S.C. 154(b) by 239 days.

(21) Appl. No.: 11/524,642

(22) Filed: Sep. 21, 2006

(65) Prior Publication Data

US 2007/0066103 A1 Mar. 22, 2007

(30) Foreign Application Priority Data

Sep. 22, 2005 (EP) ..... 05020723

(51) Int. Cl.
*H01H 37/76* (2006.01)
*H01H 85/00* (2006.01)
*F42C 15/40* (2006.01)

(52) U.S. Cl. ..... 337/409; 337/407; 337/401; 200/61.08; 102/263

(58) Field of Classification Search ..... 337/401, 337/407, 409; 439/152; 200/61.08; 102/263
See application file for complete search history.

(56) References Cited

U.S. PATENT DOCUMENTS 2,091,424 A * 8/1937 Triplett ..... 337/277
4,258,939 A * 3/1981 Karlen ..... 285/124.4
4,342,978 A 8/1982 Meister et al.
4,374,605 A * 2/1983 Bratt ..... 439/578
4,385,216 A 5/1983 Cinquin et al.
4,417,519 A * 11/1983 Lutz ..... 102/263
4,479,105 A * 10/1984 Banes ..... 337/4
4,624,518 A * 11/1986 Seidel ..... 439/400
4,852,494 A * 8/1989 Williams ..... 102/263
4,897,040 A * 1/1990 Gerke et al. ..... 439/401
5,124,679 A * 6/1992 Kanazawa ..... 335/18
5,483,210 A * 1/1996 Otterberg et al. ..... 335/18
5,808,253 A * 9/1998 Hatakeyama ..... 200/61.08
5,908,326 A * 6/1999 Neuhauser et al. ..... 439/399
6,344,788 B1 * 2/2002 Forys et al. ..... 337/401
6,519,128 B1 * 2/2003 Nakamura et al. ..... 361/115
6,549,387 B1 * 4/2003 Nakamura et al. ..... 361/93.1

OTHER PUBLICATIONS

EPO Search Report dated Mar. 23, 2006.

* cited by examiner

*Primary Examiner*—Jayprakash N Gandhi
*Assistant Examiner*—Bradley H Thomas
(74) *Attorney, Agent, or Firm*—Patrick M. Griffin

(57) ABSTRACT

An apparatus for the cutting of an electrical conductor has an electrical conductor arranged in a housing, a pyrotechnic drive and a cutting device. After the triggering of the drive, the cutting device enters into engagement with the conductor to cut it.

7 Claims, 5 Drawing Sheets

APPARATUS FOR THE CUTTING OF AN ELECTRICAL CONDUCTOR

TECHNICAL FIELD

The present invention relates to an apparatus for the cutting of an electrical conductor in order to be able to interrupt high electric currents, in particular DC currents, fast and irreversibly in emergencies in the event of overload situations. Pyrotechnic drives are used in apparatus of this type, which are generally known, to interrupt the electrical conductor with the help of a cutting element.

BACKGROUND OF THE INVENTION

It is the object of the present invention to provide an apparatus of the initially named kind which has a compact construction with a fast triggering.

SUMMARY OF THE INVENTION

This object is satisfied by an electrical conductor arranged in a housing and formed at least sectionally as a hollow conductor, with a cutting device in the region of the section formed as a hollow conductor entering into engagement with the interior of the hollow conductor to cut it after the triggering of a pyrotechnic drive.

In accordance with the invention, the conductor to be cut is partly made as a hollow conductor so that it is possible to introduce the cutting device into the interior of the hollow conductor. Not only a very compact construction is hereby achieved, but it is also possible to cut the hollow conductor from the inside to the outside by the cutting device, which is possible with substantially lower forces than if the hollow conductor were cut from the outside to the inside.

The hollow conductor can preferably be formed in the manner of a closed sleeve. The sleeve does not, however, necessarily have to be completely closed or circular in shape.

Advantageous embodiments of the invention are described in the description, in the drawing and in the dependent claims.

In accordance with a first advantageous embodiment, the hollow conductor is made in sleeve form and is in particular made in the form of a closed sleeve in the section and the cutting device enters into engagement with the sleeve substantially along the total interior periphery after the triggering of the drive. In this embodiment, a particularly fast and reliable cutting of the conductor is ensured since, on the one hand, a cutting takes place along the total interior periphery and since, on the other hand, the conductor can be made with comparatively thin walls due to its sleeve-like formation.

In accordance with a further advantageous embodiment, the cutting device has a piston, which in particular diverges conically, and a spreading sleeve. The piston can hereby be moved into the interior of the spreading sleeve with the help of the drive, with the spreading sleeve spreading outwardly due to the conically diverging shape of the piston and thereby cutting the hollow conductor. To facilitate the spreading of the spreading sleeve, it can be slit regionally. It can furthermore be advantageous also to provide the hollow conductor with openings, in particular slits, since the cutting or the spreading of the hollow conductor is hereby facilitated.

The cutting process is facilitated by providing that the hollow conductor and the spreading sleeve have openings, in particular slits, which coincide with one another.

In accordance with a further advantageous embodiment, the cutting device has a piston which is cuttable from the drive. A compact module is provided in this manner, in which the piston does not have to be installed separately.

In accordance with a further advantageous embodiment, the apparatus is made in tubular form overall and has connection means for cables, in particular eyelets or crimp elements, at its two ends. An extremely compact cutting device is provided in this manner which can be used universally, since only the conductor to be interrupted has to be connected to the connection means.

In accordance with a further advantageous embodiment, the housing has a reception space for segments of the hollow conductor cut by the cutting device, with the reception space being practically completely filled with parts of the conductor and of the cutting device after the cutting has taken place. In this embodiment, the size of the reception space is selected such that, when the triggering has taken place, practically no air is located in the region of the cut conductor, whereby a light arc which can arise under current closure on electrical separation does not form at all or extinguishes itself again within a very short time.

In accordance with a further advantageous embodiment, the conductor is a stamped part which is shaped at least sectionally to form a sleeve, in particular a closed sleeve. A stamped part of this type can be made in a cost favorable manner from sheet metal, e.g. from a copper sheet or an aluminum sheet, and permits a favorably priced manufacture despite the extremely high mechanical demands on precision. The stamped part can be stamped out of band material and rolled over a winding mandrel to obtain the sleeve-like design. In accordance with a further advantageous embodiment, in this process, the stamped part can have, at two oppositely disposed rims, a plurality of sections interconnectable in a shape-matched manner and made complementary to one another, said sections being inserted into one another to form a sleeve on winding. An extremely firm connection results at the cutting site in this manner.

In accordance with a further advantageous embodiment, the housing has a ring-shaped shearing edge, whereby the hollow conductor can be cut simultaneously along its total periphery.

BRIEF DESCRIPTION OF THE DRAWINGS

The present invention will be described in the following purely by way of example with reference to advantageous embodiments and to the enclosed drawings. There are shown.

DESCRIPTION OF THE PREFERRED EMBODIMENT

Figure 1:
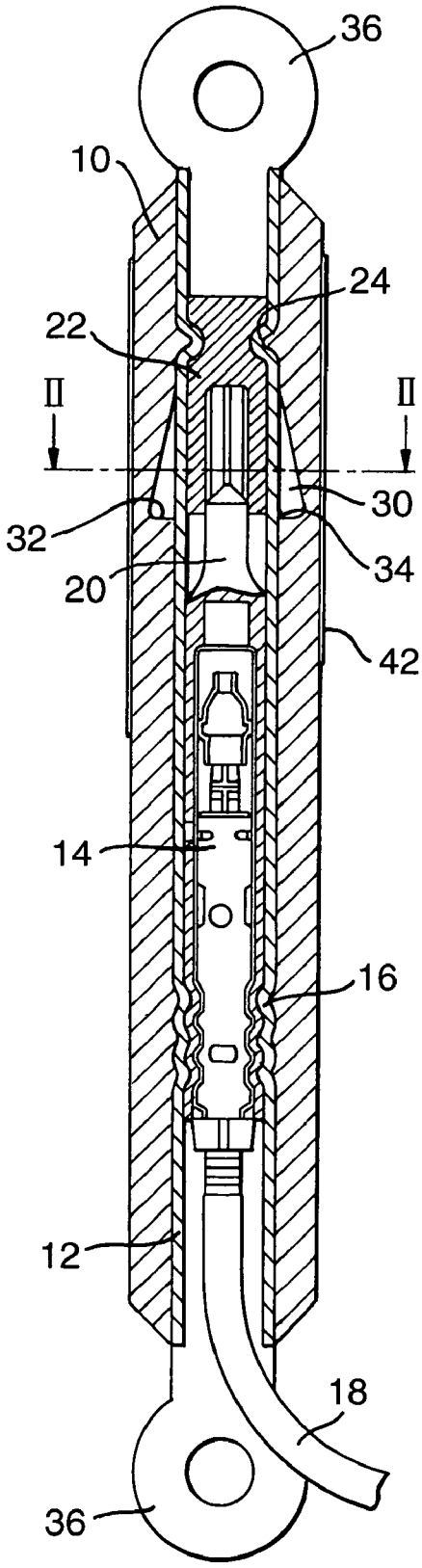
FIG. 1 is a longitudinal section through an embodiment of an apparatus for the cutting of an electrical conductor.
Figure 2:
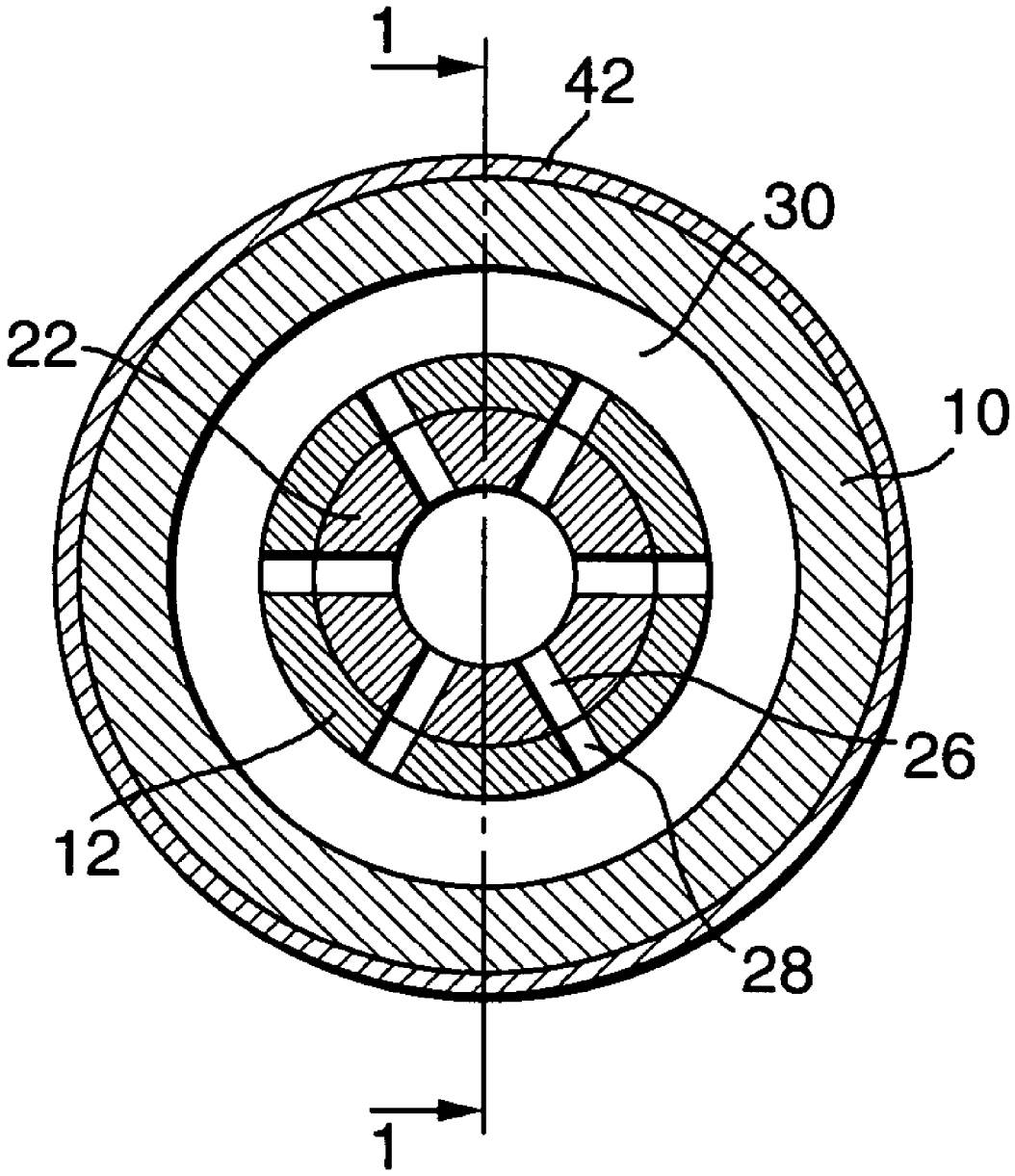
FIG. 2 is a section along the line II-II of FIG. 1.

FIG. 1 shows a longitudinal section through an apparatus for the cutting of an electrical conductor with a tubular housing 10 made of plastic in which an electrical conductor 12 is arranged. A pyrotechnic drive unit 14 which is connected to the conductor 12 by a plurality of peripheral beads 16 and whose ignition lead 18 is guided out of the housing 10 is located inside the electrical conductor 12 which is shaped to form a closed, cylindrical sleeve in the region of the housing.

The front end of the pyrotechnic drive 14, which substantially consists of plastic, is provided with an integrally shaped piston 20 whose frontmost tip is conical. This conical tip is adjoined by a circular cylindrically shaped section which subsequently diverges conically on the internal diameter of the sleeve-shaped conductor 12. The drive 14 is arranged in the conductor 12 in this process such that the conical tip is just located in the interior of a spreading sleeve 22 which is connected to the conductor 12 by a peripheral bead 24. The spreading sleeve 22 consists of plastic and is formed over its periphery with—in the embodiment shown—a total of six slits 26 downwardly open in the direction of the drive.

Figure 5:
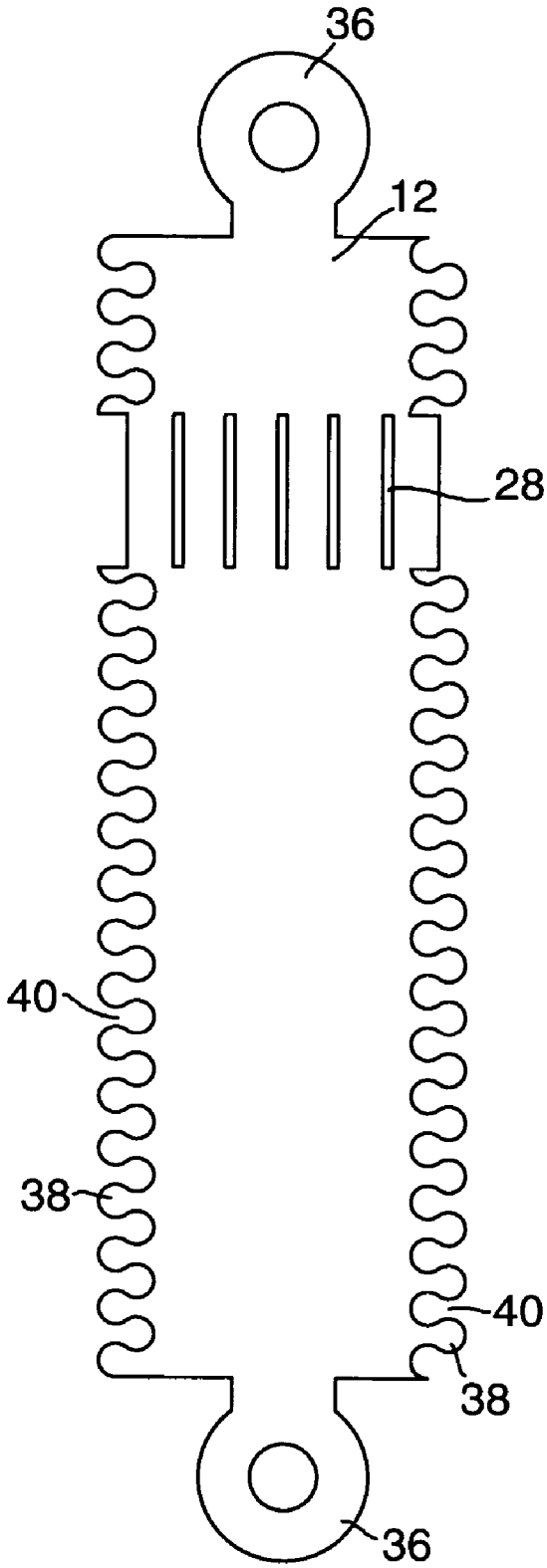
FIG. 5 is the planar development of a stamped part serving as an electrical conductor.

As in particular FIG. 5 shows, the conductor 12 is likewise provided with a total of six corresponding openings in the form of slits 28 so that the spreading sleeve 22 and the conductor 12, which is tubular in this section, form corresponding segments.

The housing 10 consisting of plastic is provided in the region of these segments at the outer periphery of the conductor 12 with a conical reception space 30 which tapers conically from the drive 14 in the direction of the closed end of the spreading sleeve 22. The base 32 of the reception space 30 forms a shearing edge 34 which contacts the outer periphery of the lead 12, is of peripheral circular shape and with whose help the tubular conductor 12 can be sheared off when the piston 20 is cut from or cracked off the drive 14 and penetrates into the spreading sleeve 22.

FIG. 5 shows a planar development of a stamped part of sheet metal from which the conductor 12 is manufactured. As can be recognized, it is a generally parallelepiped-shaped section at whose narrow sides eyelets 36 are shaped to which a conductor to be cut can be connected. The two longitudinal sides of the strip-like section are provided with a plurality of tongues 38 which taper and diverge, with complementary cut-outs 40 being formed between these tongues which permit a shape-matched connection to be generated at the "seam", which can be subjected to a high mechanical load, after the winding of the stamped part to form a closed sleeve, in that the tongues 38 are pressed into the oppositely disposed cut-outs 40.

For the assembly of the apparatus shown in FIG. 1, the stamped part shown in FIG. 5 is stamped out of band material and rolled over a precise winding mandrel to form a cylindrical tube. Subsequently, the pre-assembled drive 14 is inserted into the interior of the tube and secured in the conductor 12 with the help of the beads 16. The spreading sleeve 22 is likewise inserted into the interior of the tubular conductor 12 and is secured therein with the help of the bead 24. The unit pre-assembled in this manner can subsequently be arranged in the housing 10. Finally, a reinforcing tube 42 is pushed onto the housing 10 to reinforce it in the region of the cutting site.

FIG. 1 shows the apparatus in accordance with the invention in the state of rest, i.e. before the triggering of the drive 14. In this state, the piston 20 is integrally connected to the drive unit 14. On the triggering of the drive unit 14 with the help of an electrical pulse, a pyrotechnic charge is ignited in the drive unit 14 which generates gas pressure and the piston 20, which is connected to the drive 14 via a tear-off notch serving as a desired break point, is separated from the drive. The piston 20 thereupon moves with a high energy in the direction of the spreading sleeve 22 and, on the impact of the section of the piston 20 which diverges conically, the segments of the spreading sleeve are radially outwardly accelerated or pressed such that the segments located between the slits 28 of the conductor 12 are sheared off along the shearing edge 34.

Figure 3:
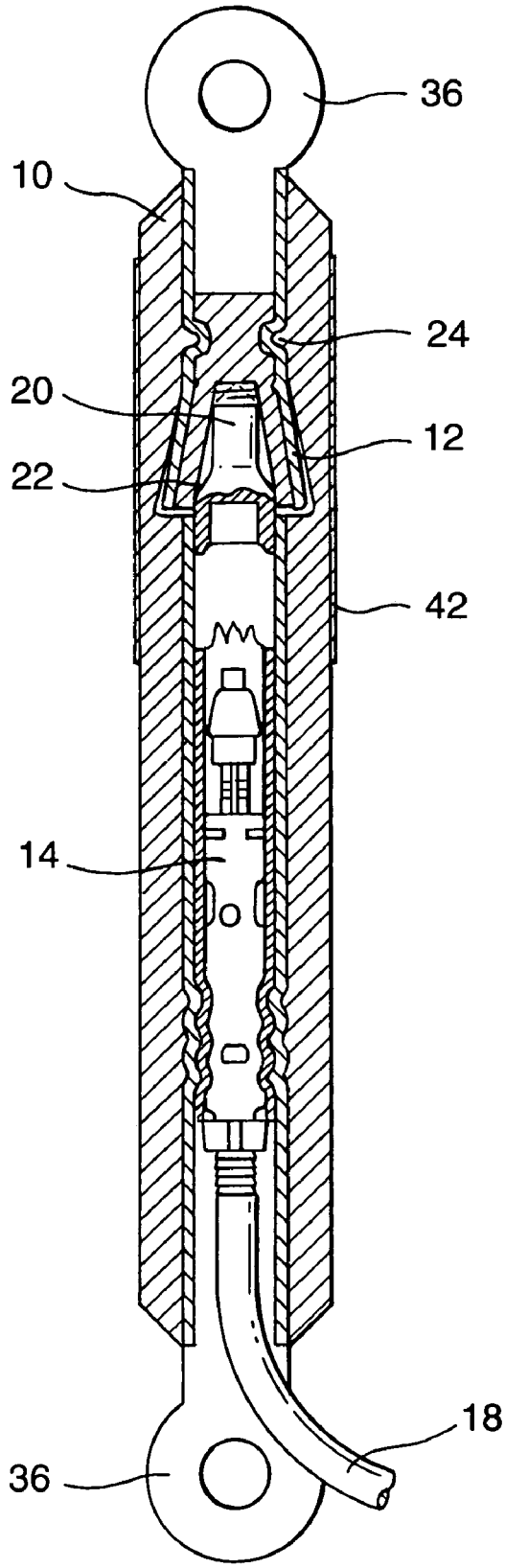
FIG. 3 is a longitudinal section through the embodiment of FIG. 1 after the cutting process has taken place.

FIG. 3 shows the apparatus of FIG. 1 after the cutting has taken place. As can be recognized, the piston 20 remains stuck in the interior of the spreading sleeve and so provides an irreversible cutting. The conductor 12 is cut along its whole periphery and the cut segments of the conductor 12 and the segments of the spreading sleeve 22 almost completely fill up the reception space 30.

Figure 4:
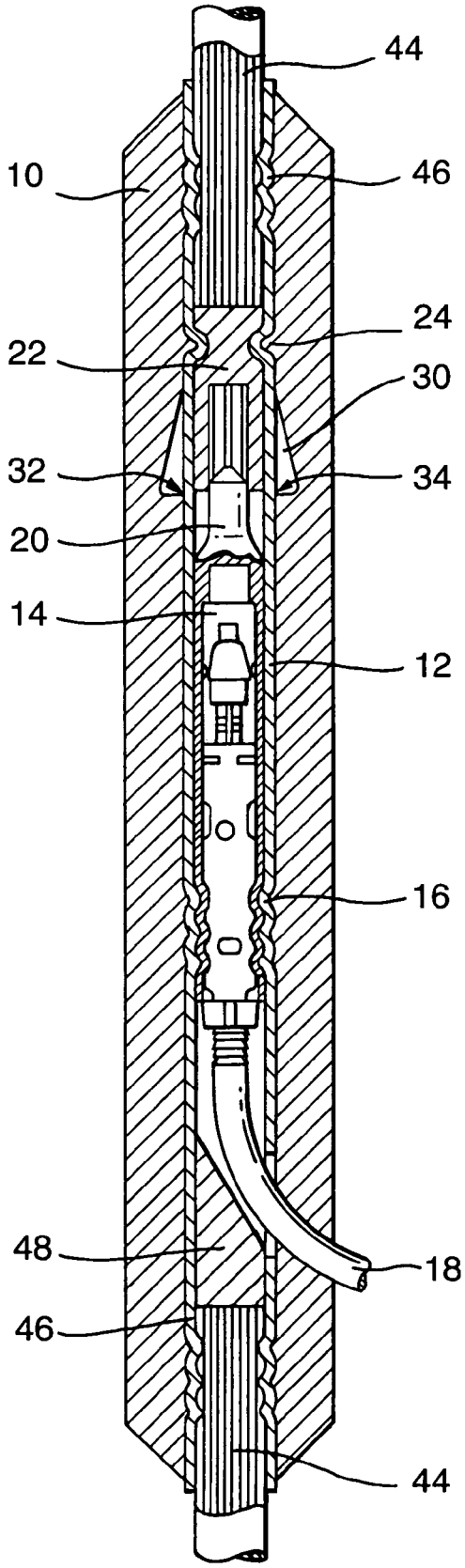
FIG. 4 is a longitudinal section through a further embodiment of an apparatus for the cutting of an electrical conductor.

FIG. 4 shows a further embodiment of an apparatus for the cutting of an electrical conductor which differs from the embodiment described above substantially in that, instead of the eyelets 36, a conductor 44 to be cut is crimped into the tubular conductor 12 by means of crimp connections 46. The ignition lead 18 in this embodiment is guided out of the housing 10 at the side via a cable guiding plug 48. The reinforcement tube 42 is omitted in the representation of the drawing in this embodiment.

The invention claimed is:

1. An apparatus for the cutting of an electrical conductor comprising:

a housing;

an electrical conductor arranged in the housing and having a hollow conductor section having a wall;

a pyrotechnic charge disposed within the hollow conductor section;

a spreading sleeve disposed within the hollow conductor section and comprising an open end facing the pyrotechnic charge, said open end comprising a cutting edge inboard the hollow conductor section and adapted to be displaced outwardly to cut the wall of the hollow conductor section; and a piston disposed within the hollow conductor section intermediate the pyrotechnic charge and the spreading sleeve and comprising a tip adapted to be received in the open end of the spreading sleeve in response to triggering of the pyrotechnic charge and to displace the cutting edge outwardly to cut the wall of the hollow conductor section.

2. An apparatus in accordance with claim 1, characterized in that the hollow conductor section includes segments separated by longitudinal slits, and the spreading sleeve includes segments separated by longitudinal slits that extend from the open end and coincide with the slits in the hollow conductor section.

3. An apparatus in accordance with claim 1, characterized in that the apparatus has a generally tubular shape and comprises connection means for cables at ends thereof, wherein the connection means comprises eyelets or crimp elements.

4. An apparatus in accordance with claim 1, characterized in that the housing comprises a shearing edge adapted to cooperate with the cuffing edge of the spreading sleeve to sever the wall of the hollow conductor section, and defines a reception space disposed about the hollow conductor section adjacent to the spreading sleeve to receive the severed portions of the wall of the hollow conductor section after the cutting.

5. An apparatus in accordance with claim 1, characterized in that the conductor is a stamped part shaped at least sectionally to form a sleeve.

6. An apparatus in accordance with claim 5, characterized in that the stamped part has a plurality of sections which are interconnectable in a shape matched manner and are made complementary to one another.

7. An apparatus in accordance with claim 1, characterized in that the housing comprises a ring-shaped shearing edge.

* * * * *